United States Patent [19]

Hurner

[11] Patent Number: 4,632,080

[45] Date of Patent: Dec. 30, 1986

[54] OIL ADDITION APPARATUS

[76] Inventor: Erwin E. Hurner, 320 Eighth St. West, West Fargo, N. Dak. 58078

[21] Appl. No.: 776,914

[22] Filed: Sep. 17, 1985

Related U.S. Application Data

[63] Continuation-in-part of Ser. No. 658,400, Oct. 5, 1984, Pat. No. 4,542,718, which is a continuation-in-part of Ser. No. 561,839, Dec. 15, 1983, Pat. No. 4,475,498, and a continuation-in-part of Ser. No. 561,739, Dec. 15, 1983, Pat. No. 4,522,167, which is a continuation-in-part of Ser. No. 218,918, Dec. 22, 1980, Pat. No. 4,421,078, which is a continuation-in-part of Ser. No. 192,077, Sep. 29, 1980, abandoned.

[51] Int. Cl.[4] ..... F02B 77/08; F01M 11/12

[52] U.S. Cl. ..... 123/196 S; 123/196 R; 123/198 D; 184/103.1; 184/6.4

[58] Field of Search ..... 123/196 R, 196 S, 198 D; 184/6.4, 103.1, 105.1

[56] References Cited

U.S. PATENT DOCUMENTS

| | | | |
|---|---|---|---|
| 2,564,231 | 8/1951 | Pitney | 184/103.1 |
| 3,147,821 | 9/1964 | Eggenberger | 123/196 S |
| 3,876,037 | 4/1975 | Rath, Jr. | 184/103.1 |
| 3,939,470 | 2/1976 | Arai et al. | 123/196 S |
| 4,012,012 | 3/1977 | Ligler | 123/196 S |

*Primary Examiner*—Ira S. Lazarus

*Attorney, Agent, or Firm*—Bailey & Hardaway

[57] ABSTRACT

A novel oil addition device which is operable on vehicles frequently maintained in operational condition on unlevel surfaces for extended periods of time.

5 Claims, 1 Drawing Figure

OIL ADDITION APPARATUS

CROSS REFERENCE TO RELATED APPLICATIONS

This application is a continuation-in-part of application Ser. No. 658,400, filed Oct. 5, 1984, now U.S. Pat. No. 4,542,718, issued Sept. 24, 1985, which in turn is a continuation-in-part of application Ser. No. 561,839, filed Dec. 15, 1983, now U.S. Pat. No. 4,475,498, and also a continuation-in-part of application Ser. No. 561,739, filed Dec. 15, 1983, now U.S. Pat. No. 4,522,167, issued June 11, 1985, which in turn is a continuation-in-part of application Ser. No. 218,918, filed Dec. 22, 1980, now U.S. Pat. No. 4,421,078, issued Dec. 20, 1983, which in turn was a continuation-in-part of application Ser. No. 192,077, filed Sept. 29, 1980, now abandoned. The disclosures therein are hereby incorporated by reference.

BACKGROUND OF THE INVENTION

This invention relates generally to the art of internal combustion engines and more particularly to the lubrication of such engines.

In the field of over-the-road trucking, it is highly desirable to be able to minimize the amount of service required on a vehicle in order that the vehicle be available for use on the road for a maximum percentage of the time. The changing of oil and corresponding filter accounts for a substantial amount of the maintenance during its lifetime. Further, the service life of diesel engines is directly related to the cleanliness of the oil run in the engine.

U.S. Pat. No. 4,495,909 which is related to the current application describes an apparatus for providing fresh oil to a lubrication system in response to measurement of low levels within that system. As described in that patent oil is added during periods of engine operation in response to continuous low readings.

In the area of busing, particularly those buses which operate in urban environments, it is not uncommon for such buses to be parked on unlevel surfaces for extended periods of time. The oil addition devices thus described in my prior U.S. Patent becomes somewhat unsatisfactory for that particular circumstance.

SUMMARY OF THE INVENTION

It is thus an object of this invention to provide an oil addition device which is operable on vehicles which are frequently maintained in operational condition on unlevel surfaces for extended periods of time.

It is a further object of this invention to provide a novel oil addition device.

These as well as other objects are accomplished by an improvement to an internal combustion engine which has an ignition system to activate the engine and a lubrication system for lubricating parts of the engine which include an oil pan which improvement is directed to a reservoir of oil communicating with an oil pan through a conduit having a valve therein. The improvement resides in control for the valve which establishes fluid communication between the reservoir and the oil pan which is responsive to deactivation of the ignition system as well as the oil level within the oil pan.

BRIEF DESCRIPTION OF THE DRAWING

The FIGURE of drawing schematically illustrates the apparatus in accordance with this invention.

DETAILED DESCRIPTION

Figure 1:
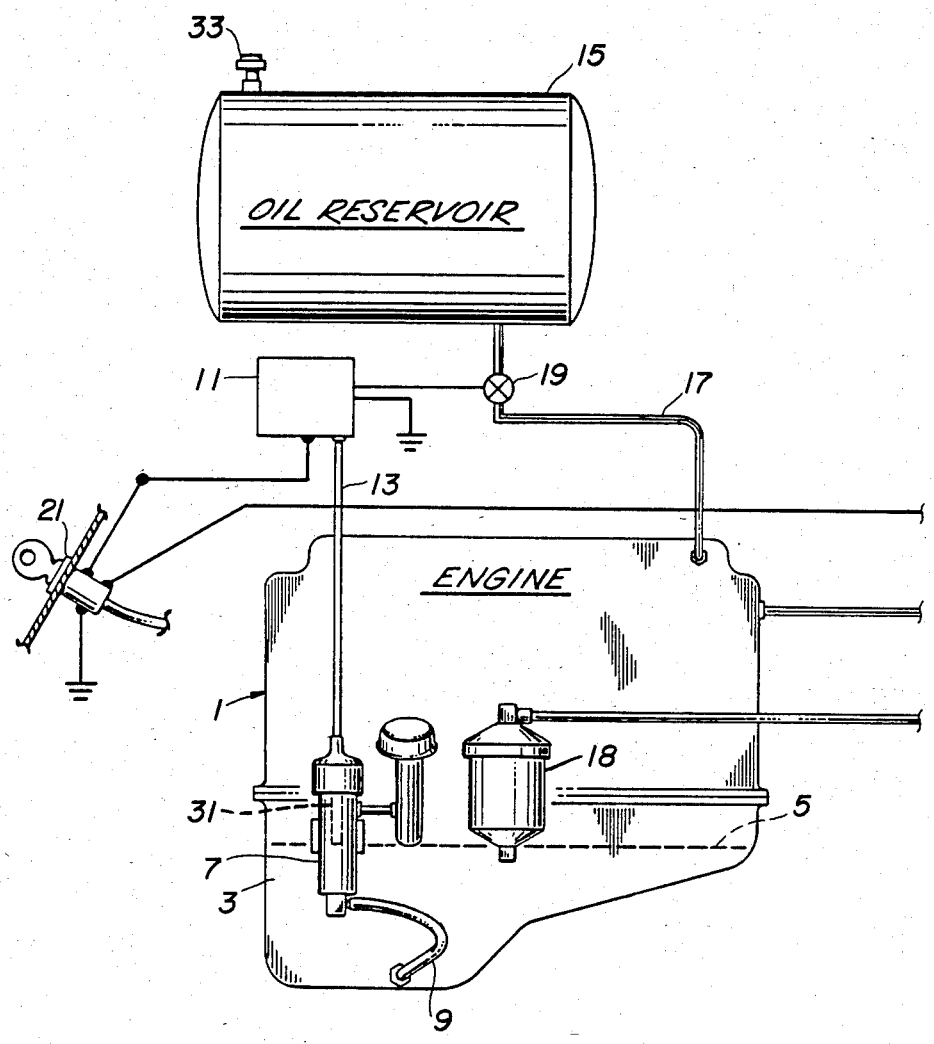

In accordance with this invention it has been found that a novel oil addition device may be provided which is operable to maintain adequate oil levels within vehicles which frequently are parked on unlevel surfaces with engines running for extended periods of time. The invention is particularly adapted for utilization on urban busing systems, particularly those operating on diesel engines. Various other features and advantages will become apparent from a reading of the following description given with reference to the FIGURE of drawing.

The FIGURE of drawing illustrates an engine 1 having an oil pan 3 with a desired level of oil illustrated at 5. A testing chamber 7 is in communication with the oil pan 3 through conduit means 9. The testing chamber 7 is preferably of the type described in my U.S. Pat. No. 4,522,167 which is herewith incorporated by reference. As described in that patent, chamber 7 provides means for monitoring the level of oil within the oil pan 3. Such monitor is in communication with control means 11 through connection 13.

An oil reservoir 15 communicates with the lubrication system and oil pan through conduit means 17. Conduit means 17 has therein a solenoid activated valve 19 so as to control the flow of fresh lubricating oil from reservoir 15 into oil pan 3. As described in my issued U.S. Pat. No. 4,495,909, it is preferred in that system to use a pressurized oil reservoir. However, for purposes of the subject invention, it is preferred to utilize a gravity feed reservoir for reasons which will become apparent from the following continued description.

Control means 11 is adapted to conform to situations wherein vehicles are parked for extended periods of time on unlevel surfaces thus giving rise to an opportunity for false readings of oil levels due to the unlevel surfaces. Thus, in order to overcome this shortcoming, control means 11 becomes operational after deactivation of ignition system 21. The oil addition apparatus of this thus only adds oil during periods of non-engine operation rather than during engine operation as described in my prior U.S. Patent.

Control means 11 is provided with a timer which becomes activated upon deactivation of ignition system 21. It is contemplated that the system will become operational upon placement of the vehicle within a garage for periods of storage. Such garage and storage areas are generally contemplated as being level. Control means 11 with its timer thus activates and opens solenoid valve 19 after a first predetermined period of time. It is preferred that this period of time be approximately 15 minutes in order to be assured that the vehicle is indeed in a storage situation. Timer means provides for shutoff after valve 19 has been opened for a second predetermined period of time subject to level control to be discussed further. The second predetermined period of time is also preferably 15 minutes.

As discussed above, test chamber 7 contains a probe 31 which communicates through 13 to control means 11 indicating the level of oil within oil pan 3. Probe 31 is set at a desired oil level of maintenance system and upon arrival of that desired level for probe 31, control means 11 is responsive to close solenoid valve 19 and thus interrupt the fluid communication between oil reservoir 15 and oil pan 3.

Since the apparatus of this invention is normally operable after periods of engine operation wherein engine compartments are warm and generally contemplated to be within garage structures, it is preferred that the oil reservoir simply be permitted to gravity feed through conduit means 17. It is thus realized that a vent 33 must be provided on the reservoir in order for such gravity feed to occur. However, should placement of the reservoir within the engine compartment preclude the desired gravity feed, a pressurized reservoir of the type described in my U.S. Pat. No. 4,495,909 may be utilized.

It is thus seen that the oil addition device of this invention provides a novel and improved system for adding oil to engine lubrication systems so as to maintain a desired level even when such vehicles are maintained in an operational condition on unlevel surfaces for extended periods of time. As many variations will become apparent to those of skill in the art from a reading of the foregoing specification, such variations are embodied within the spirit and scope of this invention as defined by the following appended claims:

What is claimed is:

1. In an internal combustion engine having an ignition system and a lubrication system to lubricate parts of said engine including an oil pan, the improvement, comprising:

a reservoir of fresh lubricating oil;

conduit means for establishing fluid communication between said reservoir and said oil pan;

valve means for opening and closing said conduit means; and control means for said valve means to establish fluid communication between said reservoir and said oil pan responsive to deactication of said ignition system.

2. The improvement according to claim 1 wherein said control means comprises a timer to activate said valve means to establish fluid communication between said reservoir and said oil pan after a first predetermined period of time after deactivation of said ignition system.

3. The improvement according to claim 2 wherein said control means further includes means to deactivate said valve means to prevent fluid communication between said reservoir and said oil pan after a second predetermined period of time after deactivation of said ignition system.

4. The improvement according to claim 3 further comprising a chamber in fluid communication with said oil pan and a level monitor within said chamber established at a predetermined desired oil level.

5. The improvement according to claim 4 further comprising communication between said monitor and said control means to deactivate and close said valve means upon establishment of said desired oil level.

* * * * *